United States Patent [19]

Haikkala

[11] 4,270,703

[45] Jun. 2, 1981

[54] METHOD OF AND A GRINDER FOR DISCHARGING GROUNDWOOD STOCK WHEN GRINDING WOOD UNDER PRESSURE

[75] Inventor: Pekka O. Haikkala, Tampere, Finland

[73] Assignee: Oy Tampella Ab, Tampere, Finland

[21] Appl. No.: 6,155

[22] Filed: Jan. 24, 1979

[30] Foreign Application Priority Data

Feb. 16, 1978 [FI] Finland ..... 780515

[51] Int. Cl.[3] ..... B02C 23/24

[52] U.S. Cl. ..... 241/18; 241/28; 241/281; 241/DIG. 14

[58] Field of Search ..... 241/DIG. 14, 18, 28, 241/152 A, 220, 221, 222, 280, 281

[56] References Cited

U.S. PATENT DOCUMENTS

| | | | |
|---|---|---|---|
| 1,099,557 | 6/1914 | Lorenz et al. | 241/DIG. 14 |
| 1,713,510 | 5/1929 | Briner | 241/18 |
| 3,808,090 | 4/1974 | Logan et al. | 241/28 X |
| 3,948,449 | 4/1976 | Logan et al. | 241/28 X |

*Primary Examiner*—Richard B. Lazarus

*Attorney, Agent, or Firm*—Ladas & Parry

[57] ABSTRACT

A method of discharging groundwood stock when grinding wood under pressurized conditions in a grinding chamber, according to which the groundwood is suspended into stock and collected in a tank provided with an outflow for groundwood stock to atmospheric pressure. The surface of the stock in said tank is maintained at such a level above said outflow, that the stock in said tank forms a pressure lock in the communication between the grinding chamber and said outflow. In this way the discharging of the groundwood stock out from said grinding chamber is carried out as a sluicing step, whereby a continuous pressure can be maintained in the grinding chamber in spite of discharging of groundwood stock.

2 Claims, 1 Drawing Figure

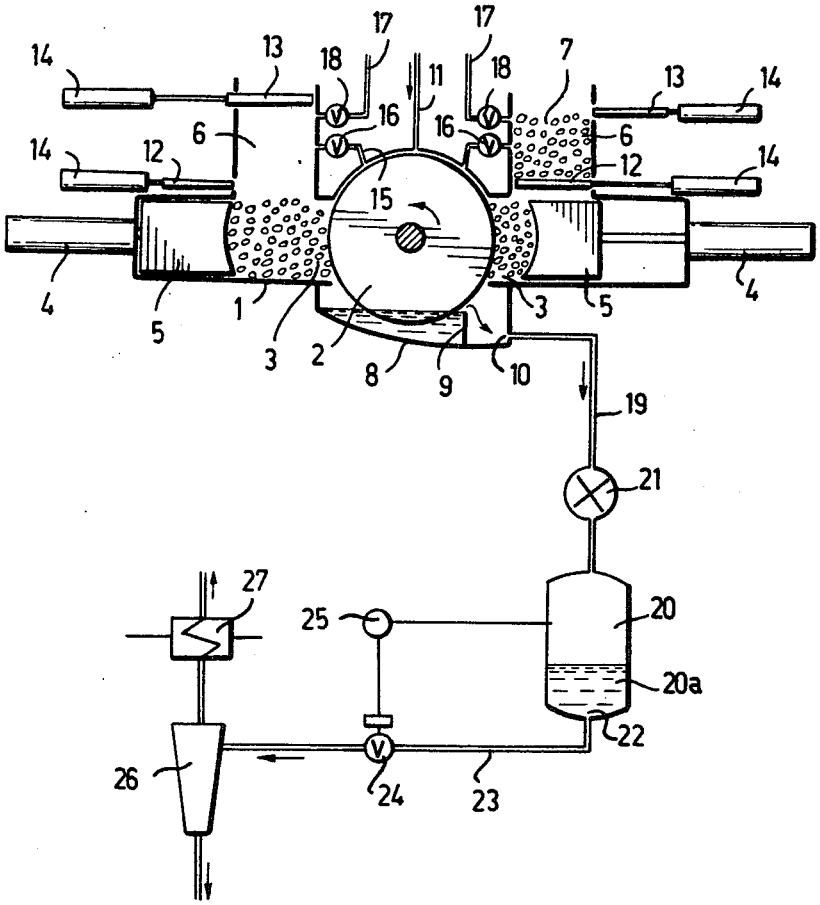
14
13
18
17
11
17
18
7
13
14
14
12
6
16
16
6
12
14
15
4
5
1
3
2
8
9
10
3
5
4
19
21
27
25
20
20a
22
26
24
23

METHOD OF AND A GRINDER FOR DISCHARGING GROUNDWOOD STOCK WHEN GRINDING WOOD UNDER PRESSURE

The present invention relates to a method of discharging groundwood stock when grinding wood under pressurized conditions in a grinder comprising a pressurized gas-filled grinding chamber for a rotating grinding means according to which method the groundwood is suspended into stock in the grinding chamber and discharged in suspended form from the grinding chamber.

It is well known to grind wood by pressing a wood batch by means of a pressing element against a rotating grinding stone while simultaneously feeding shower water into the grinding chamber. By means of a dam the surface of the obtained suspended groundwood stock has been kept in the grinding chamber a little higher than the lower surface of the stone in order to clean, lubricate and cool the stone. The groundwood stock flowing over the dam has been discharged by its own weight from the grinding chamber for further treatment.

It is also known, for example from U.S. Pat. Nos. 3,808,090 and 3,948,449, that the groundwood can be improved by grinding wood in a closed grinding chamber in a pressurized gaseous atmosphere. The gas consists of air, steam or an inert gas, and the overpressure of the gas may rise up to about 1.4–2.8 bar. In the grinder described in said patents wood is fed batchwise, and the pressurized gaseous atmosphere of the grinding chamber can be maintained only as long as the grinding of a wood batch continues but as soon as a new wood batch is fed into the magazine the pressure in the grinding chamber becomes atmospheric. Below the grinding chamber there is a tank in which the groundwood stock obtained by grinding a wood batch is collected and which is emptied in connection with the feeding of a new wood batch into the grinding chamber, whereby the grinding chamber is relieved of overpressure. Thus the grinder cannot work under a continuously pressurized atmosphere in the grinding chamber.

In order to maintain a continuously pressurized atmosphere in the grinding chamber it is necessary, among other things, that the groundwood stock can be discharged from the grinding chamber to atmospheric pressure so that the overpressure in the grinding chamber does not disappear.

The object of the present invention is to obtain a method which eliminates said difficulties and makes it possible to discharge the stock without causing a harmful effect on the pressurized gaseous atmosphere in the grinding chamber of the grinder. This object is achieved by means of a method according to the invention, the main characteristic of which is that the groundwood stock is discharged from the grinding chamber under pressure through a pressure lock formed by the groundwood stock.

The invention is based on the idea that the discharge of the stock out from the grinding chamber is carried out as a sluicing step, whereby for discharging is used a slice in which the groundwood stock itself serves as a lock which maintains the pressure in the grinding chamber during the discharging.

The invention relates also to a grinder for carrying out the method and the main characteristic of this grinder is that the discharging device comprises a tank for the groundwood stock which forms a pressure lock between the grinding chamber and the atmospheric pressure.

In the following the invention will be described more detailed with reference to the enclosed drawing which is a diagrammatic view of an embodiment of a grinder according to the invention.

The grinder shown in the drawing comprises a frame 1 and a grinding stone 2 which is rotatably mounted in the frame. On both sides of the grinding stone there is a pressure-tight grinding chamber 3. In each grinding chamber a pressure shoe 5 is provided which is displaceable by means of a hydraulic cylinder 4. Above each grinding chamber a vertical feeding chamber 6 is provided for a wood batch 7 to be fed into the grinding chamber. The feeding chamber has a lower opening communicating with the grinding chamber and an upper opening communicating with the atmosphere. Below the grinding stone the frame forms a pit 8 which is provided with an overflow 9 and an outflow 10. Hot shower water is fed on the grinding stone by nozzles which are not shown. A grinder of the type described above is known per se, and therefore it will not be further described. The grinder is further provided with a feed pipe 11 for pressurized air in order to subject the grinding chambers to a pressure.

The lower and upper openings of each feeding chamber is pressure-tightly sealed by means of parallel shutters 12,13 which are displaced by hydraulic cylinders 14. Thus the feeding chamber and the shutters form a pressure-tight sluice. The feeding chamber is connected to the grinding chamber through a pipe 15 which can be closed by means of a valve 16, and to the atmosphere through a pipe 17 which can be closed by means of a valve 18.

According to the invention the outflow 10 of the grinder is connected through a pipe 19 to a pressure-tight tank 20. Said pipe 19 is provided with a stick crusher 21 positioned between the grinding chamber 3 and a control valve, in this case between the grinding chamber and the tank 20. At the bottom of the tank there is an outflow 22 which is connected to an outflow pipe 23 which can be closed by means of a control valve 24 or a rotary valve. The valve is operated by means of a pressure difference detector 25 which communicates with the interior of the tank.

The grinder operates as follows:

A wood batch is pressed by the pressure shoe 5 against the grinding stone in the right-hand grinding chamber of the grinder. A new wood batch has been brought into the feeding chamber 6, whereby the lower shutter 12 of the chamber is pressure-tightly closed and the upper shutter 13 is open. The valve 16 in the pipe to the grinding chamber is closed. The same applies to the valve 18 to the atmosphere. When the feeding chamber is filled the upper shutter is pressure-tightly closed. Thereafter the valve 16 in the pipe to the grinding chamber is opened so that the pressure in the feeding chamber becomes the same as the pressure in the grinding chamber. When the wood batch in the grinding chamber has been ground and the pressure shoe has been displaced to its receiving position the lower shutter 12 is opened so that the new wood batch falls from the feeding chamber into the grinding chamber as shown in the left-hand part of the grinder. Thereafter the lower shutter 12 and the valve 16 are closed and the valve 18 to the atmosphere is opened, whereby the pressure in the feeding chamber becomes atmospheric.

The upper shutter 13 can now be opened and a new wood batch can be brought into the feeding chamber.

The groundwood is collected in the pit 8 of the grinder and forms in the pit a damm of groundwood stock with a consistency of 0.8–4%. This stock generally contains sticks, chips, and pieces of wood which have passed the grinding process. The surface of the damm is about 2–10 cm higher than the lower surface of the grinding stone. The stock suspension flows over the overflow and by its own weight further to the stick crusher 21 in which the sticks, chips and pieces of wood which passed the grinding process are crushed into smaller pieces in order to prevent the choking of the valve 24. From the crusher the stock flows to the tank 20, the interior of which is under the same pressure as the grinding chambers, for example 0.8–3.0 bar. This pressure tends to force the stock from the tank through the outlet pipe 23 but the outflow of stock is controlled by the valve 24 and the pressure difference detector 25 so that the surface of the groundwood stock **20*a* in the tank is always at a preset level above the outlet of the tank. This layer in the tank prevents the pressure from disappearing from the grinding chambers through the tank 20**.

It is observed that the above-described discharging system makes it possible to discharge groundwood stock from a grinder under continuous pressure and to maintain the desired overpressure in the grinder at the same time.

The temperature of the groundwood stock discharged from the tank 20 is generally 100°–140° C. The stock is passed to a steam separator, for example a cyclone 26, in which the temperature of the stock falls below 100° C. From the lower part of the cyclone the stock is passed to further treatment, and the heat of the released steam is recovered by means of a heat exchanger 27.

The object of the drawing and the description is only to illustrate the idea of the invention. In details the method and the grinder for carrying out the method can vary considerably within the scope of the claims. In case no stick crusher 21 is used the tank 20 can be directly connected to the pit 8 of the grinder, possibly as an extension thereof.

What I claim is:

1. A method of continuously processing wood, comprising the steps of substantially continuously grinding the wood in the presence of water by means of a grinder which comprises a rotating grinding means disposed in a pressurized gas-filled grinding chamber and thereby forming a primary groundwood stock in the grinding chamber under superatmospheric pressure, passing the primary groundwood stock from the grinding chamber to a stick crusher while maintaining the stock under superatmospheric pressure, employing the stick crusher to crush sticks present in the primary groundwood stock, while maintaining the stock under superatmospheric pressure, thereby to produce a secondary groundwood stock under superatmospheric pressure, passing the secondary groundwood stock to a valve, while maintaining the stock under superatmospheric pressure, and continuously discharging secondary groundwood stock through the valve while preserving a hydraulic seal of secondary groundwood stock upstream of said valve.

2. A method according to claim 1, comprising the step of adjusting the rate of discharge of secondary groundwood stock through the valve so as to maintain the level of secondary groundwood stock upstream of said valve at a preset level.

* * * * *